US010480320B2

(12) United States Patent
Bhagwat et al.

(10) Patent No.: US 10,480,320 B2
(45) Date of Patent: Nov. 19, 2019

(54) OVAL BAR

(71) Applicant: MINOVA INTERNATIONAL LIMITED, Barnsley (GB)

(72) Inventors: Anand Bhagwat, Tipp City, OH (US); Stephen C. Tadolini, Lakewood, CO (US)

(73) Assignee: MINOVA INTERNATIONAL LIMITED, Barnsley (GB)

( * ) Notice: Subject to any disclaimer, the term of this patent is extended or adjusted under 35 U.S.C. 154(b) by 0 days.

(21) Appl. No.: 15/913,455

(22) Filed: Mar. 6, 2018

(65) Prior Publication Data

US 2018/0291738 A1 Oct. 11, 2018

Related U.S. Application Data

(60) Provisional application No. 62/467,635, filed on Mar. 6, 2017.

(51) Int. Cl.
*E21D 21/00* (2006.01)
*E21D 20/02* (2006.01)

(52) U.S. Cl.
CPC ..... *E21D 21/0026* (2013.01); *E21D 21/0006* (2013.01); *E21D 20/026* (2013.01)

(58) Field of Classification Search
CPC ..... D07B 2201/2002; D07B 5/005; E21D 21/0006; E21D 21/0026; E21D 21/006
See application file for complete search history.

(56) References Cited

U.S. PATENT DOCUMENTS 4,430,025 A * 2/1984 Ciavatta ..... E21D 20/02 405/259.1
5,054,146 A * 10/1991 Wiesenfeld ..... B21B 1/163 405/259.5
5,775,850 A * 7/1998 Gale ..... E21D 21/0026 405/259.1
6,309,159 B1 * 10/2001 Weaver ..... E21D 21/0026 405/259.1
2008/0141614 A1 * 6/2008 Knouff ..... B29C 53/14 52/857
2013/0209192 A1 * 8/2013 Wood ..... E21D 21/004 411/82
2015/0121801 A1 * 5/2015 Yu ..... E04C 5/02 52/851

* cited by examiner

*Primary Examiner* — Carib A Oquendo
(74) *Attorney, Agent, or Firm* — William H. Honaker; Dickinson Wright PLLC

(57) ABSTRACT

The present invention is a manually bendable rebar bolt for use in ground reinforcement, particularly in mining operations. The rebar bolt is a steel rod having a length and a width. The cross-sectional area of the bolt taken along the width generally perpendicular to said length has a long axis and a short axis. The bendable rebar bolt can be manually bent in a direction generally perpendicular to said long axis.

11 Claims, 3 Drawing Sheets

OVAL BAR

RELATED APPLICATIONS

This application claims the benefit of U.S. Provisional Application No. 62/467,635 filed on Mar. 6, 2017, which is incorporated herein by reference in its entirety.

STATEMENT REGARDING FEDERALLY SPONSORED RESEARCH

NONE.

TECHNICAL FIELD

This invention relates generally to ground reinforcement and in particular ground reinforcement in the mining industry.

BACKGROUND OF THE INVENTION

As is well known in ground reinforcement and in particular ground reinforcement in the mining industry, there are numerous apparatus and methods used in rock bolting for strata control. An internationally accepted method of strata control is resin-anchored rebar or bolts. Typically, the rebar's surface is patterned or deformed to form a better mechanical interlock or bond between the bar, resin and the rock mass. These reinforcing methods are intended to react to rock mass movement, develop a restraining force and transfer that force back to the rock mass.

Typically, resin anchored bolts require a borehole to be drilled in the ground reinforcement, such as for example a mine roof or wall. A resin cartridge is inserted into the borehole and then the bolt is inserted and rotated to rupture the resin cartridge.

Rebar typically is between four (4) and eight (8) in length to provide the necessary length to penetrate into the rock mass and can provide at least ten (10) inches for attaching fasteners etc. In order to insert the rebar into a bore hole, the working space typically must be higher than the length of the bolt. In some applications, the working space is less than six (6) feet. This is common in mining operations when the coal seam narrows. To accommodate for lower seam underground mining heights, where the required penetration depth is higher than the existing mine opening height; the bars have to be bent during or prior to the installation process. As is known to those of ordinary skill in the art, the rebar has to be bent manually by the roof bolt operator. To facilitate bending, the rebar is deformed to a narrow section close to the middle of the bar. The narrow section allows the rebar to be bent with less force than would be required if there were no narrowed section.

It is difficult, if not impossible, to bend rebar larger than no. 5 (⅝-inch diameter). Traditionally, to facilitate bending of the bar, the bar is mechanically modified by heating the bar in a separate process and stamping it with a high impact hydraulically operated ram. This process, called "Hot-Notching", consists of a specially designed heating unit for gas or induction heating. The rebar is placed on a conveyor with the center portion of the bar being exposed to the heat source and the remaining end portions of the bar not being exposed to heat. The conveyor moves the bar through at a predetermined variable speed (controlled by sensors) so the bar is the correct temperature. The heated rebar is then hydraulically stamped to flatten the center section. This process doesn't remove any material from the roof bolt; it simply moves the material to a flattened position to facilitate bending.

The problem with this method is that it requires very costly machinery, is very labor intensive, is very costly, and the heating and deformation changes the steel property characteristics.

There is also a mechanical method for reducing the thickness of the bar diameter by removing a section of the steel material. This process is completed by feeding the bolts into a hydraulic machine that "grinds" the material into the predetermined form and at the location where the bends are required (every mine can have a different specification on the location of the bend(s) based on mining height and machine operator preference. The final web-thickness is critical for regulatory requirements for minimal bolt strength.

As with the previous method, this method also suffers from the problem that it requires costly machinery, is labor intensive, is very costly, and the deformation changes the steel property characteristics.

As described, the hot-notch or mill-notch processes requires considerable labor, expensive equipment and costly heat energy. Additionally, the Regulatory requirements spelled out in ASTM F432-13 to manufacture, measure and test the products can result in bad material, customer complaints and potential bolt failure with inadequate mine roof support.

What is needed is a cost effective rebar or bolt that can be manually bent when needed but that doesn't affect the material characteristics of the rebar.

SUMMARY OF THE INVENTION

In general terms, this invention provides a manually bendable rebar bolt for use in ground reinforcement. The rebar bolt is a steel rod having a length and a width and a cross-sectional area taken along the width generally perpendicular to the length. The cross-sectional area has a long axis and a short axis, in the disclosed embodiment it is an oval. Because of the shorter side, the bendable rebar bolt can be manually bent in a direction generally perpendicular to the long axis.

In the disclosed embodiment, the ratio of the short axis to said long axis is at least about 0.5 and less than 1.0. In the preferred embodiment, the ratio of the short axis to the long axis is at least about 0.650 and less than 0.95 inches. The cross-sectional area has a long axis that is about 0.90 inches and a short axis of about 0.60 inches.

These and other features and advantages of this invention will become more apparent to those skilled in the art from the detailed description of a preferred embodiment. The drawings that accompany the detailed description are described below.

DETAILED DESCRIPTION OF A PREFERRED EMBODIMENT

The present invention overcomes the disadvantages of the known methods for making bendable rebar. The present invention provides a preformed oval or elliptical bar 10 having a cross sectional area 20 with a short axis 12 and a long axis 16. The oval or elliptical bar shape is formed while the bar is still in a malleable state. With the deformed rebar formed as an oval or elliptical bar along its length, the bar can be bent along the short axis, i.e. perpendicular to the direction of the long axis, with no additional modifications being required and the processing costs and handling are minimized. The oval cross-section will allow the bolt to be manually bent at any location along the length to suit specific seam height.

The bar exceeds all strength requirements using the ASTM F432-13 standards for yield and tensile strength. By controlling the profile i.e. making it flatter or thinner in the minimum diameter direction, the force needed to bend the bar can be controlled to any desired requirements.

Figure 1:
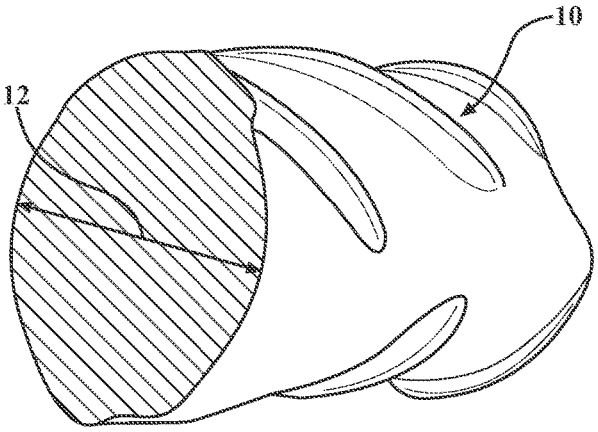
FIG. 1 is a partial perspective view of the oval or elliptical bar of the present invention.
Figure 2:
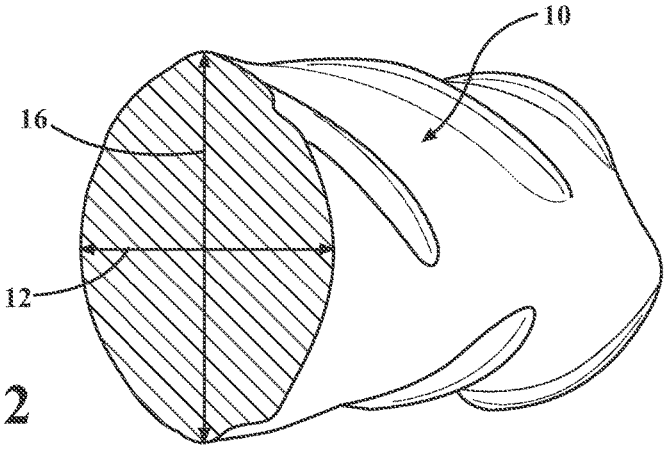
FIG. 2 is an end view of the oval or elliptical bar of the present invention.
Figure 3:
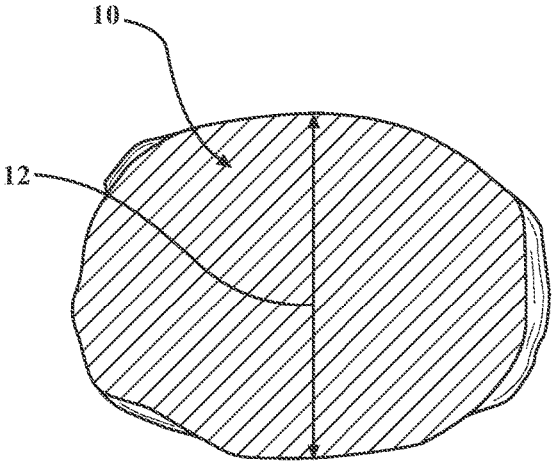
FIG. 3 is an end view of the bolt installation head of the oval or elliptical bar of the present invention.
Figure 4:
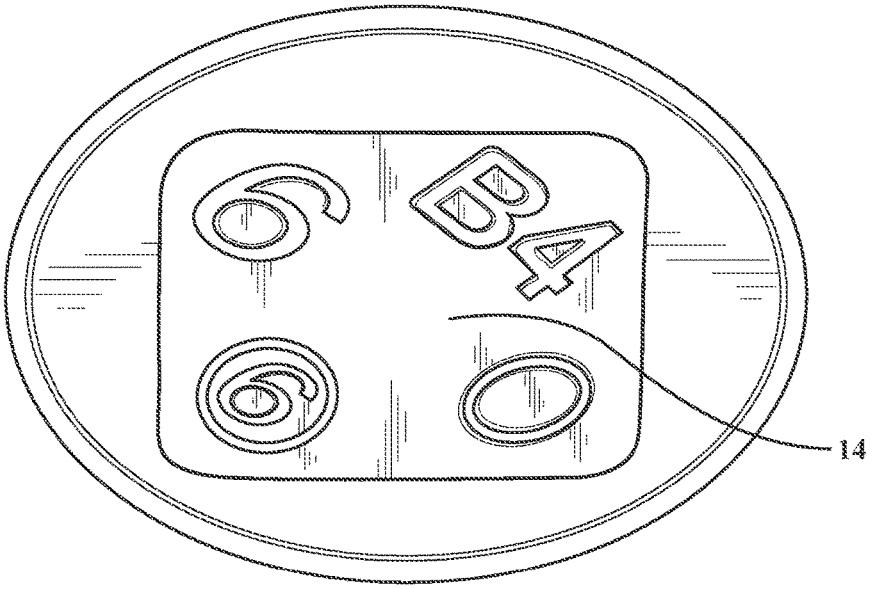
FIG. 4 is a schematic view of rollers to roll the oval or elliptical bar of the present invention.
Figure 5:
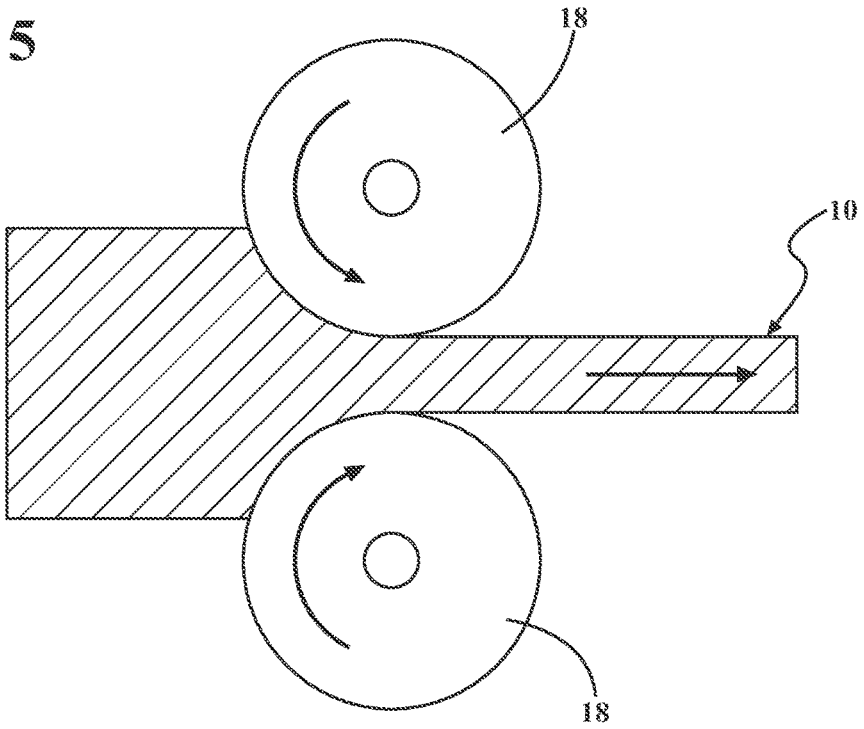
FIG. 5 is a schematic perspective view of the oval or elliptical bar of the present invention.

The oval and elliptical bars can also have required bolt installation heads 14, see FIG. 4, forged by traditional forging methods. Although traditional forged heading processes are designed for bars with a circular shape, the present invention is capable of being forged by traditional processes. The bar is heated to the required temperature and then struck to form an initial cone and then again to form the head that is used to facilitate bolt installation in a mine (the head develops the designed bolt capacity). The heads are formed by gathering the material from the oval/elliptical shape and the resulting heads meet all specifications and strength requirements.

A major additional benefit that is realized by forming the bar in an oval shape is the reduced annulus (distance between drilled borehole wall and the bar). This reduced distance creates an installation advantage. The oval shape also creates a paddle shape that facilitates mixing of the resin. The reduced annulus or paddle enhances the tearing of the resin film cartridge and assists with mixing by pushing the resin through a small space. For example in a 1 inch (25 mm) diameter hole the oval bar will have a 0.600" minor axis 12 and a 0.938 inch major axis 16 that results in a 0.062" distance between the borehole wall and the bolt which will result in a vigorous mixing during installation and fast spin cycles along the entire length of the bolt.

The oval or elliptical bar of the present invention is formed by standard rebar forming operations initially. A billet of steel is heated and forced through a series of rollers 18 to from the round shape of the rebar. At the final stage, a further series of rollers 18 form the oval or elliptical shape of the present invention.

Tests were performed to establish that the oval bar of the present invention has equal cross-section and tensile strength as #6 Grade 40 standard rebar, and not lower reinforcement level and volume of steel per $in^3$.

The initial testing was intended to evaluate head-to-head anchorage capacity of oval bars against current round bars. The short encapsulation pull tests (SEPT) were conducted in the presence of MSHA Tech Support and MSHA District 3.

The Test Conditions and Results:

Two sets of rebar bolts were tested for the SEPT:

Oval Rebar Bolts—0.650"×0.900" Grade 40, 6 ft in length, headed. Mechanical properties of the bar were tensile strength 88,100 ksi and yield strength 54,100 ksi.

Round Rebar Bolts—#6 Grade 40, 6 ft in length, headed.

Figure 6:
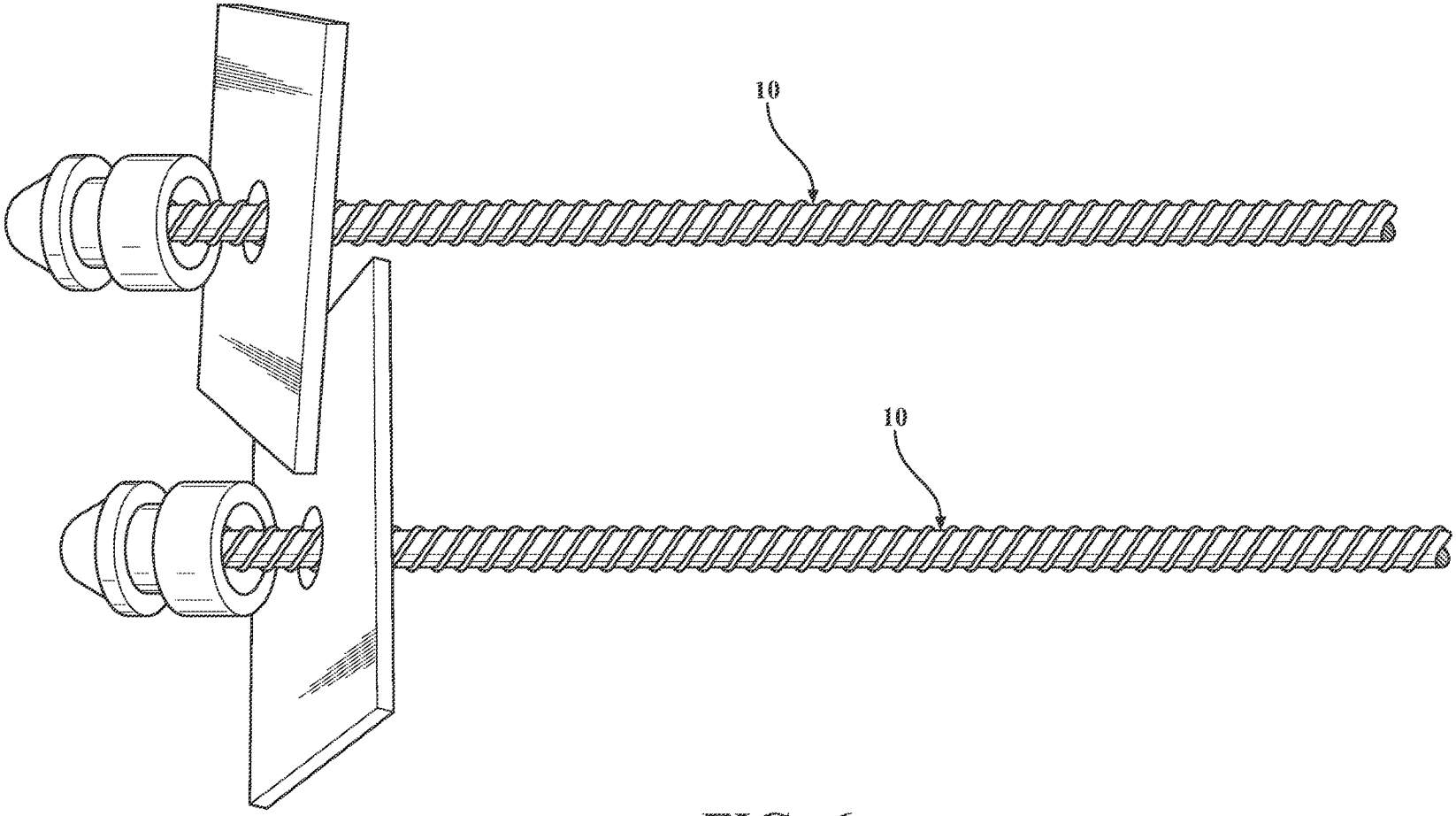
FIG. 6 is a perspective view of the oval or elliptical bar of the present invention including oval or rebound rebar bolts installed thereon.

The bolts were installed with 8"×8"×⅜" flat plates and pull collars, and B23 M35LIF resin (as shown in FIG. 6).

The resin cartridges were cut to 9.5" for 12" grout coverage.

Results and Observations:

All of the bolts were pulled to nine (9) tons. The data showed that the oval bolts performed equal or better than standard round bars without excessive permanent displacement.

CONCLUSION

The oval bolts performed equal or better than standard #6 Grade 40 round bar bolts.

In a further test by MSHA, a full spectrum of tests was conducted on both oval rebars and #6 Grade 40 hot notched rebars for conformance to ASTM F432-13. The conclusions reached were both oval and round rebar bolts exceeded ASTM F432-13 standard for Grade 40 for yield and tensile loads.

The hot notched section of the round #6 Grade 40 bolts conformed to the standard for minimum breaking load after bending and straightening. Bent and straightened oval rebars performed identical to the original sections. Breaking loads of hot notched bars were lower than oval bars, reflecting the detrimental effect of reheating of the steel.

Overall, oval rebar bolt passed all the tests to be considered as replacement to notched rebar bolts. The oval bars also met all requirements of a #6 Grade 40 resin bolt.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

We claim:

1. A manually bendable rebar bolt for use in ground reinforcement, said rebar cable bolt comprising:

a steel rod having a length and a width and a cross-sectional area taken along said width generally perpendicular to said length, said cross-sectional area having an oval or elliptical shape including a long axis and a short axis;

whereby said oval or elliptical shape of said cross-sectional area allows a user to manually bend said steel rod in a direction generally perpendicular to said long axis;

wherein a ratio of said short axis to said long axis is at least about 0.6 and less than 0.8;

wherein a length of said long axis is less than or equal to 0.9 inches and a length of said short axis is greater than or equal to 0.6 inches.

2. The manually bendable rebar bolt of claim 1, wherein the length of said short axis is about 0.6 inches and the length of said long axis is 0.9 inches.

3. The manually bendable rebar bolt of claim 1, wherein said rebar is #6 grade 40.

4. The manually bendable rebar bolt of claim 1, wherein said long axis is less than 0.9 inches and said short axis is greater than 0.6 inches.

5. A manually bendable rebar bolt for use in ground reinforcement, said rebar cable bolt comprising:

a rod having a cross-sectional area, said cross-sectional area having an oval or elliptical shape including a long axis and a short axis, said rebar bolt having a width along said long axis and a width along said short axis;

a ratio of said short axis to said long axis is at least about 0.6 and less than 0.8;

wherein a length of said long axis is less than or equal to 0.9 inches and a length of said short axis is greater than or equal to 0.6 inches;

whereby said oval or elliptical shape of said cross-sectional area allows a user to manually bend said rod in a direction generally perpendicular to said long axis.

6. The manually bendable rebar bolt of claim 5, wherein the length of said short axis is about 0.6 inches and the length of said long axis is 0.9 inches.

7. The manually bendable rebar bolt of claim 5, wherein said rebar is #6 grade 40.

8. The manually bendable rebar bolt of claim 5, wherein said long axis is less than 0.9 inches and said short axis is greater than 0.6 inches.

9. A manually bendable rebar bolt for use in ground reinforcement, said rebar cable bolt comprising:

a rod having a length a width and a cross-sectional area taken along said width generally perpendicular to said length, said cross-sectional area having an oval or elliptical shape including a long axis and a short axis, a ratio of said short axis to said long axis is at least about 0.6 and less than 0.8, a length of said long axis is less than or equal to 0.9 inches and a length of said short axis is or equal to 0.6 inches;

whereby said oval or elliptical shape of said cross-sectional area allows a user to manually bend said rod in a direction generally perpendicular to said long axis.

10. The manually bendable rebar bolt of claim 9, wherein said rebar is #6 grade 40.

11. The manually bendable rebar bolt of claim 9, wherein said long axis is less than 0.9 inches and said short axis is greater than 0.6 inches.

* * * * *